US009305738B2

(12) United States Patent
Liu et al.

(10) Patent No.: US 9,305,738 B2
(45) Date of Patent: Apr. 5, 2016

(54) ELECTRON EMISSION DEVICE AND REFLEX KLYSTRON WITH THE SAME

(71) Applicants: Tsinghua University, Beijing (CN); HON HAI PRECISION INDUSTRY CO., LTD., New Taipei (TW)

(72) Inventors: Peng Liu, Beijing (CN); Pi-Jin Chen, Beijing (CN); Duan-Liang Zhou, Beijing (CN); Chun-Hai Zhang, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/749,583

(22) Filed: Jun. 24, 2015

(65) Prior Publication Data

US 2015/0380199 A1 Dec. 31, 2015

(30) Foreign Application Priority Data

Jun. 25, 2014 (CN) ..... 2014 1 0288346

(51) Int. Cl.
*H01J 1/62* (2006.01)
*H01J 25/22* (2006.01)
*H01J 23/08* (2006.01)

(52) U.S. Cl.
CPC *H01J 25/22* (2013.01); *H01J 23/08* (2013.01)

(58) Field of Classification Search
CPC ..... H01J 1/304; H01J 3/021; H01J 31/127
USPC ..... 313/495–497, 311
See application file for complete search history.

(56) References Cited

U.S. PATENT DOCUMENTS

2005/0236963 A1 10/2005 Kang et al.
2014/0159566 A1 6/2014 Liu et al.

FOREIGN PATENT DOCUMENTS

TW 200605131 2/2006
TW 201423818 6/2014

*Primary Examiner* — Vip Patel
(74) *Attorney, Agent, or Firm* — Novak Druce Connolly Bove + Quigg LLP

(57) ABSTRACT

An electron emission device includes an anode, a cathode, an electron emitter structure, and an electron extraction electrode. The cathode is spaced from the anode. The electron emitter structure is electrically connected to the cathode. The electron extraction electrode is insulated from the cathode. The electron extraction electrode defines a through hole surrounded by a sidewall, and the electron emitter structure faces to the sidewall. The electron emitter structure includes a number of electron emitters extending toward the sidewall, each of the number of electron emitters includes an electron emission terminal, a first distance between each electron emission terminal and the sidewall is substantially the same, a second distance between the electron emission terminal and the anode is greater than or equal to 10 micrometers and smaller than or equal to 200 micrometers, and a pressure in the electron emission device is smaller than or equal to 100 Pascal.

20 Claims, 10 Drawing Sheets

ELECTRON EMISSION DEVICE AND REFLEX KLYSTRON WITH THE SAME

CROSS-REFERENCE TO RELATED APPLICATIONS

This application claims all benefits accruing under 35 U.S.C. §119 from China Patent Application No. 201410288346.6, filed on Jun. 25, 2014 in the China Intellectual Property Office, disclosure of which is incorporated herein by reference.

BACKGROUND

1. Technical Field

The present disclosure relates to a electron emission device and a reflex klystron with the same.

2. Description of Related Art

In general, the THz wave refers to a electromagnetic wave in which the frequency ranging from 0.3 THz to 3 THz or 0.1 THz to 10 THz. The band of THz wave lies between the infrared wave and the millimeter wave. The THz wave has excellent properties. For example, THz wave has certain ability to penetrate objects, and the photon energy is small, thus the THz will not cause damage to the objects. At the same time, a lot of material can absorb the THz wave.

The reflex klystron is used to emit electromagnetic wave. In order to emit THz wave, the feature size of the reflex klystron should be small and the current density of the electron rejection should be high. However, the traditional reflex klystron adopts silicon tips as the emitter, thus the feature size is large, and the current density of the electron rejection is small.

What is needed, therefore, is an electron emission device and a reflex klystron that overcomes the problems as discussed above.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present ionization electron emission device.

Figure 1:
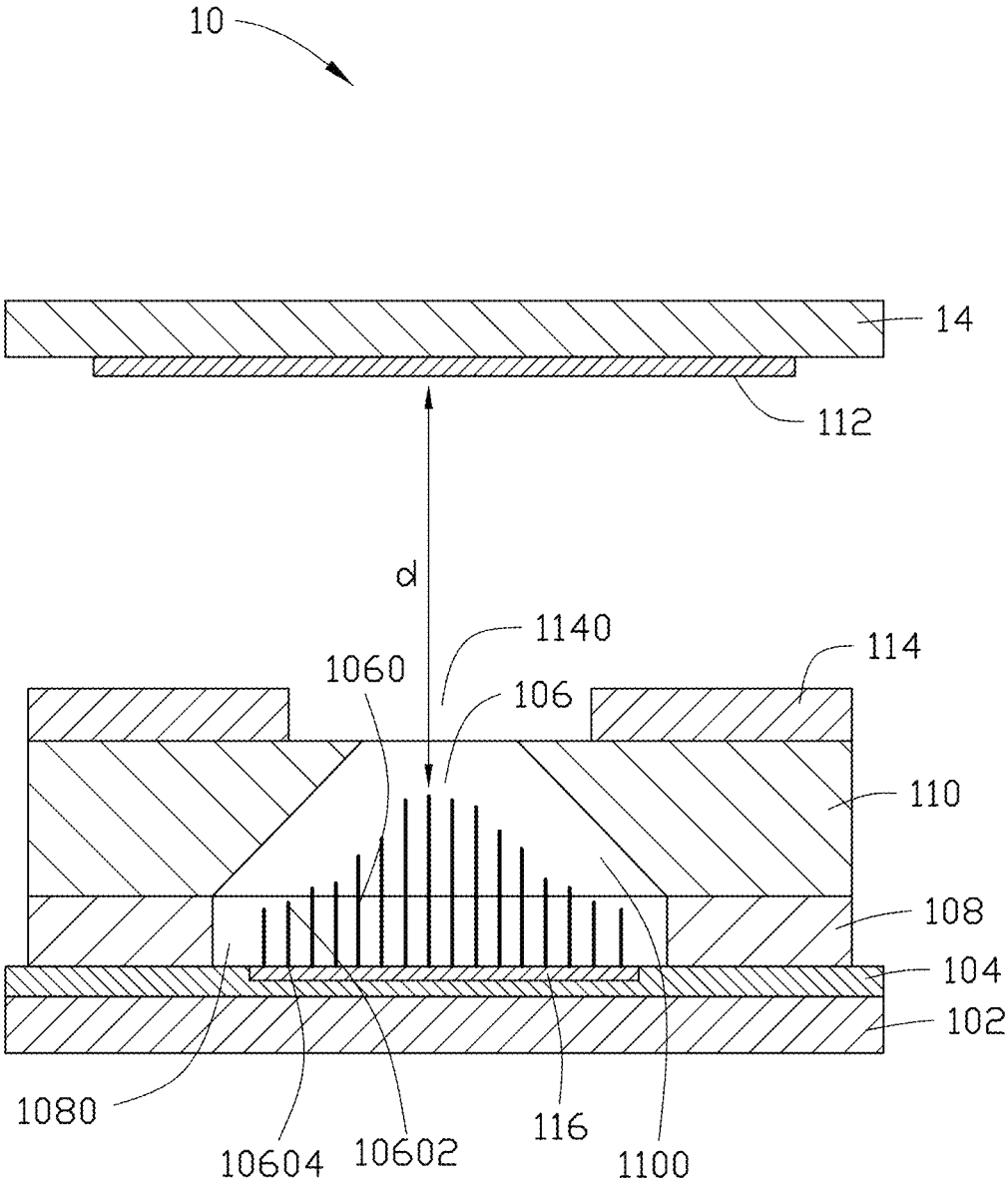
FIG. 1 is a schematic view of one embodiment of an electron emission device.

Referring to FIG. 1, an electron emission device 10 comprises an insulating substrate 102, a cathode 104, an electron emitter structure 106, an insulating layer 108, an electron extraction electrode 110, and an anode 112.

The cathode 104 is spaced from and opposite to the anode 112. The electrode emitter 106 is electrically connected to the cathode 104. The electron extraction electrode 110 is insulated from the cathode 104 via the insulating layer 108.

The cathode 104 is located on a surface of the insulating substrate 102. The insulating layer 108 covers the cathode 104. Furthermore, the insulating layer 108 defines a plurality of first openings 1080, a first portion of the cathode 104 is exposed through the plurality of first openings 1080, and a second portion of the cathode 104 is covered by the insulating layer 108. The electron emitter structure 106 is located on the first portion of the cathode 104 and electrically connected to the cathode 104. The electron extraction electrode 110 is located on the insulating layer 108. The electron extraction electrode 110 is spaced and insulated from the cathode 110 via the insulating layer 108. The electron extraction electrode 110 defines a through hole 1100, and the first portion of the cathode 104 is exposed through the through hole 1100. In one embodiment, the electron emission device 10 comprises a fixed part 114. The fixed part 114 is located on the electron extraction electrode 110 to fix the electron extraction electrode 110 to the insulating layer 108.

The insulating layer 108 can be directly located on the cathode 104. Furthermore, the insulating layer 108 can also be located on the insulating substrate 102. The cathode 104 is insulated from the electron extraction electrode 110 via the insulating layer 108. The insulating layer 108 can be a layered structure defining a plurality of first openings 1080. Furthermore, the insulating layer 108 can be formed by a plurality of strips spaced from each other, and the spaces between adjacent two strips are defined as the first opening 1080. The cathode 108 can be located on the insulating substrate 102 and exposed through the plurality of first openings 1080.

A material of the insulating substrate 102 can be silicon, glass, ceramics, plastics, or polymers. A shape and a thickness of insulating base can be selected according to actual needs. The shape of the insulating substrate 102 can be circular, square, or rectangular. In one embodiment, the insulating substrate 102 is square, the length is about 10 mm, and the thickness is about 1 mm.

The cathode 104 is a conductive layer. A material of the cathode 104 can be pure metal, alloy, semiconductor, indium tin oxide, or conductive paste. In one embodiment, the material of the insulating substrate 102 is silicon, and the cathode 104 can be doped silicon. In one embodiment, the material of the cathode 104 is a aluminum film with 20 micrometers. The aluminum film can be deposited on the insulating substrate 102 via magnetron sputtering method.

The insulating layer 108 can be resin, plastic, glass, ceramic, oxide, or their mixture. The oxide can be silica, aluminum oxide, or bismuth oxide. In one embodiment, the thickness of insulating layer 108 is about 100 micrometers.

The material of the insulating layer 108 is a circular photoresist on the cathode surface of 104. The insulating layer 108 defines a round opening, and the cathode electrode 104 is exposed through the round opening.

The electron extraction electrode 110 can be a layered electrode with the through hole 1100. The electron extraction electrode 110 can be a plurality of striped electrodes spaced from each other. The space between adjacent two striped electrodes is defined as the through hole 1100. The material of the electron extraction electrode 110 can be metal material with large rigidity such as stainless steel, molybdenum, or tungsten. The material of the electron extraction electrode 110 can also be carbon nanotubes.

A thickness of the electron extraction electrode 110 can be greater than 10 micrometers. In one embodiment, the thickness of the electrode lead electrode 110 ranges from about 30 micrometers to about 60 micrometers.

The electron extraction electrode 110 can have an oblique sidewall around the through hole 1100. An angle is defined between the oblique sidewall and the surface of the insulating substrate 102. The through hole 1100 can be in a shape of inversed funnel, and the size of the through hole 1100 is gradually narrowed along a direction away from the cathode 104. The through hole 1100 defines a second opening and a fourth opening opposite to the second opening. The fourth opening is adjacent to the cathode 104. Furthermore, an area of the second opening is smaller than an area of the fourth opening. The electron emitter structure 106 can be received in the through hole 1100. A fourth span of the fourth opening can range from about 80 micrometers to about 1 millimeter. A second span of the second opening can range from about 10 micrometers to about 1 millimeter.

The sidewall of the through hole 1100 can be planar, curved, or convex. Furthermore, a secondary electron emitting layer can be located on the sidewall. While the electrons from the electron emitter structure 106 impact the secondary electron emitting layer, a plurality of secondary electrons can be emitted from the secondary electron emitting layer. Thus the quantity of electrons can be added, and the current density can be improved. The material of the secondary electron emitting layer can be oxide, such as magnesium oxide, beryllium oxide, or diamond.

Figure 2:
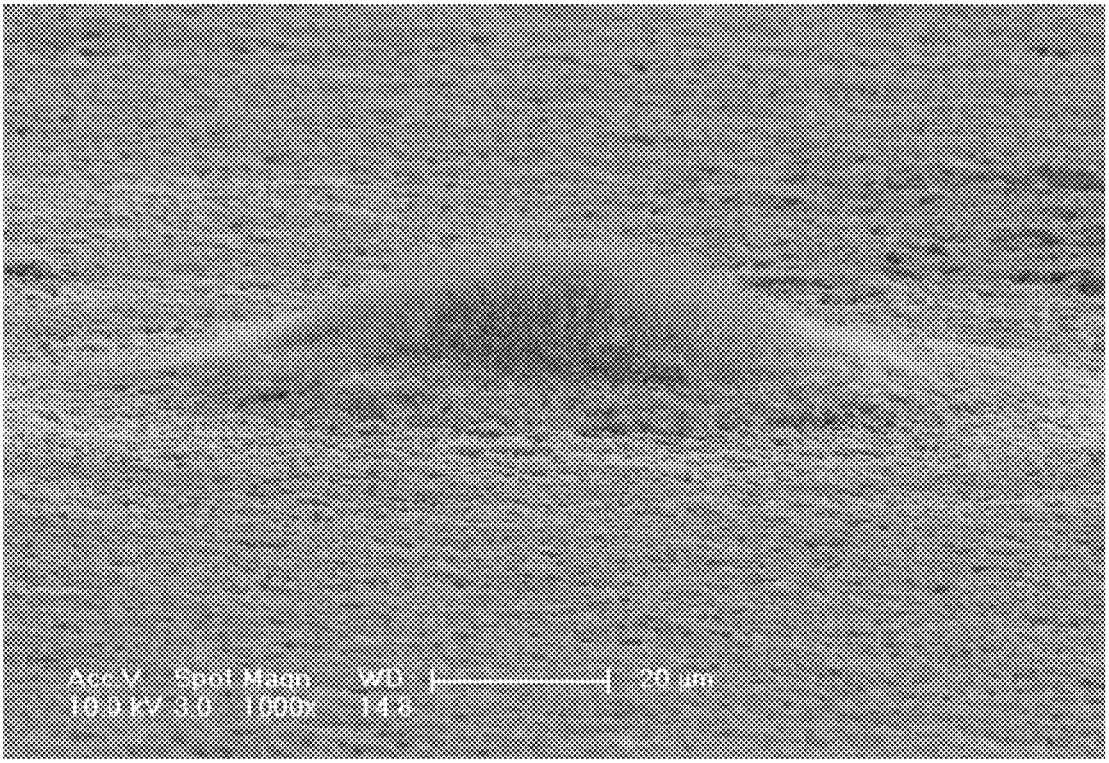
FIG. 2 is a scanning electron microscope (SEM) image of a carbon nanotube array in the electron emission device.

Referring to FIG. 2, the electron emitter structure 106 is in a shape of peak. A height of the electron emitter structure 106 at the central portion is the highest, and the height is gradually decreased along a direction away from the center. Furthermore, the central portion of the electron emitter structure 106 faces to the center of the through hole 1100. The electron emitter structure 106 comprises a plurality of electron emitters 1060. The plurality of electron emitters 1060 are parallel with each other. The electron emitter 1060 at the center of the electron emitter structure 106 is the highest. The height of the electron emitters 1060 are gradually decreased along the direction away from the center of the electron emitter structure 106.

The material of the electron emitters 1060 can be carbon nanotube, carbon fiber, or silicon nanofiber. Each of the plurality of electron emitters 1060 comprises a first end 10602 and a second end 10604 opposite to the first end 10602. The second end 10604 is adjacent and electrically connected to the cathode 104, and the first end 10602 extends toward the anode 112. The first end 10602 is configured to emit electrons as an electron emission terminal. The height of the plurality of electron emitters 1060 is greater than the thickness of the insulating layer 108, thus the first end of each of the plurality of electron emitters 1060 can extend out of the first opening 1080.

The electron emitter structure 106 is spaced from the sidewall of the through hole 1100. Furthermore, a surface of the electron emitter structure 106 away from the insulating substrate 102 can be parallel with the sidewall. In detail, a distance between each first end 10602 and the sidewall of the through hole 1100 is substantially the same. Thus the plurality of first ends 10602 and the sidewall have substantially the same distances. In one embodiment, a difference between the distances can range from about 1 micrometer to about 50 micrometers. The distance can range from about 5 micrometers to about 100 micrometers. In one embodiment, the distance ranges from about 5 micrometers to about 50 micrometers to enhance the electron emission.

Furthermore, an ion bombardment resistance material can be deposited on each of the plurality of electron emitters 1060. The ion bombardment resistance material can be zirconium carbide, hafnium carbide, or lanthanum hexaboride. The ion bombardment resistance material can protect the plurality of electron emitters 1060 from damage. Thus the lifespan of the electron emitter structure 106 can be prolonged. Furthermore, because the work function of the ion bombardment resistance material can be lower than the plurality of electron emitters 1060, thus the drive voltage can be reduced.

In one embodiment, the electron emitter structure 106 is a carbon nanotube array having a plurality of carbon nanotubes parallel with each other. The plurality of carbon nanotubes is configured as the plurality of electron emitters 1060 and extends into the through hole 1100. The carbon nanotube array can be in a shape of round. A diameter of the carbon nanotube array can range from about 50 nanometers to about 80 nanometers, the height of the carbon nanotubes can range from about 10 micrometers to about 20 micrometers. A diameter of each of the plurality of carbon nanotubes can range from about 1 nanometer to about 80 nanometers.

It can be understood, the plurality of electron emitters 1060 can extend into the through hole 1100. Furthermore, the plurality of electron emitters 1060 can also not extends into the through hole 1100, which means that the first end 10602 of the electron emitter 1060 is lower than the fourth opening. The distance between the plurality of first ends 10602 and the sidewall of the through hole 1100 is the same.

A distance between each of the plurality of the first ends 10602 and the anode 112 is defined as a feature size d. The feature size d can be greater than 50 micrometers and smaller than 100 micrometers. Furthermore, because of the plurality of electron emitters 1060 have different heights, the distances between the plurality of first ends 10602 and the anode 112 are different. However, the feature size d still ranges from 10 micrometers to about 200 micrometers.

A pressure in the inner space of the electron emission device 10 can smaller than or equal to 100 Pascal. In one embodiment, the inner space of the electron emission device 10 is vacuum. Furthermore, the inner space can also be filled with air or inert gas.

In one embodiment, while the inner space is filled with air, the absolute temperature T is 300K, the pressure is 100 Pascal, thus the mean free path $\overline{\lambda_{air}}$ of air molecular satisfies:

$$\overline{\lambda_{air}} = \frac{5\times10^{-3}\,\text{cm}}{p};$$

wherein p represents pressure in the electron emission device 10, and the unit is Torr. While p is 100 Pascal, the mean free path $\overline{\lambda_{air}}$ of air molecular is about 66 micrometers.

While the mean free path $\overline{\lambda_{air}}$ of the electrons in the air at 300K satisfies:

$$\overline{\lambda_{e\text{-}air}}=4\sqrt{2\overline{\lambda_{air}}}$$

while p is 100 Pascal, the mean free path $\overline{\lambda_{e\text{-}air}}$ of the electrons in the air is about 373 micrometers. Thus $\overline{\lambda_{e\text{-}air}}$ is greater than the feature size d. Then the electrons can reach the anode 112, and the electron emission device 10 has large current density.

In another embodiment, while the inner space of the electron emission device 10 filled with inert gas, the free path $\overline{\lambda_e}$ of the electrons in the inert gas can be calculated by:

$$\overline{\lambda_e} = \frac{4}{\pi n \sigma^2} = \frac{4kT}{\pi \sigma^2 p};$$

wherein n represents molecular density of the inert gas; σ is effective diameter of the inert gas molecule; $k=1.38\times10^{-23}$ J/K; T is absolute temperature, p is pressure.

At T=300K, p=100 Pascal, the free path of the electrons at different inert gas is shown in Table 1:

| Inert gas | Helium | Neon | Argon | Krypton | Xenon |
|---|---|---|---|---|---|
| Effective diameter($10^{-10}$ m) | 2.18 | 2.6 | 3.7 | 4.2 | 4.9 |
| Free path(μm) | 1123 | 808 | 399 | 304 | 231 |

As shown in Table 1, the free path $\overline{\lambda_e}$ of the electrons in the inert gas is greater than 200 micrometers. The feature size d of the electron emission device is smaller than 200 micrometers. Thus the free path $\overline{\lambda_e}$ is greater than the feature size d, the electrons can reach the anode 112, the emission current is greater than 100 microampere.

Furthermore, because of the feature size d of the electron emission device 10 is smaller than 200 micrometers, and the first end 102 of the electron emitters 1060 are near the anode 112, thus the driven voltage of the electron emission device 10 is small. Then the speed of the electrons from the electron emitters 1060 is not accelerated so much, thus the electrons cannot cause the ionization of the air or inert gas. Therefore, the electron emission of the electron emission device 10 cannot be affected.

The material of the fixed part 114 can be insulating material. The shape of the fixed part 114 can be same as the insulating layer 108. The fixed part 114 defines a third opening 1140 opposite to the first opening 1080 to expose the electron emitters 1060. In one embodiment, the fixed part 114 can be insulating layers formed by screen printing.

The electron emission device 10 can further comprise a resistor layer 116. The resistor layer 116 is sandwiched between the electron emitter structure 106 and the cathode 104. The electron emitter structure 106 is electrically connected to the cathode 104. The resistance of the resistor layer 116 is greater than 1 GΩ to ensure that the cathode 114 can uniformly apply current to the electron emitter structure 106. The material of the resistor layer 116 can be metallic alloy of nickel, copper, cobalt; the material of the resistor layer 116 can also be metallic alloy, metallic oxide, inorganic composition doped with phosphorus.

The anode 112 can be formed on a anode plate 14. The anode plate 14 can be transparent. In one embodiment, the anode plate 14 is glass. The anode 112 can be ITO or aluminum film.

Figure 3:
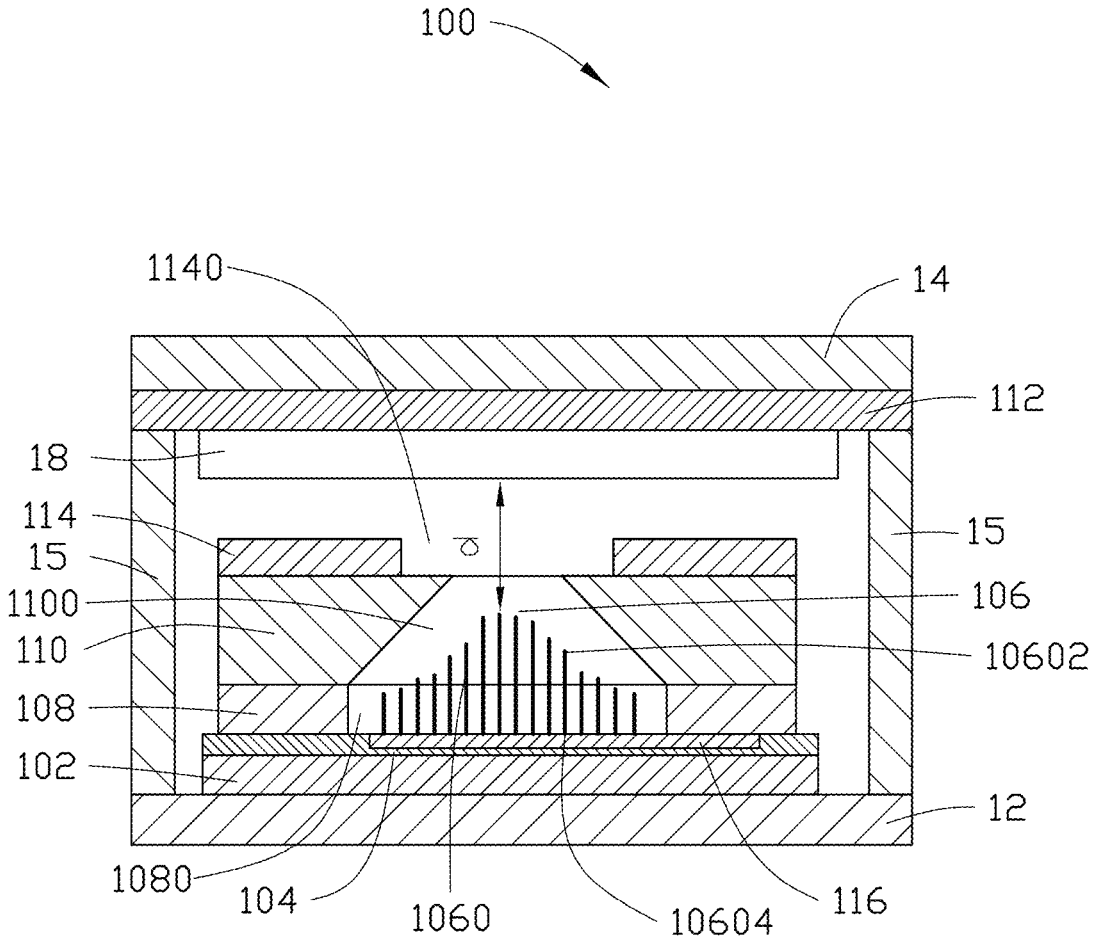
FIG. 3 shows a schematic view of one embodiment of a field emission display unit.

Referring to FIG. 3, a field emission display 100 with the electron emission device 10 is provided. The field emission display 100 comprises a cathode plate 12, a phosphor layer 18, and the electron emission device 10.

The cathode plate 12 supports the anode plate 14 via an insulating support 15. The electron emission device 10, the anode electrode 112, and the phosphor layer 18 are sealed by the cathode plate 12, the insulating support 15, and the anode plate 14. The anode 112 is located on the anode plate 14, and the phosphor layer 18 is deposited on the anode 1112. The phosphor layer 18 is spaced from the electron emission device 10. The electron emission device 10 is located on the cathode plate 12.

A material of the cathode plate 12 can be glass, ceramic, or silicon oxide. In one embodiment, the material of the cathode plate 12 is glass. The phosphor layer 18 can defines a plurality of lighting units, and each of the plurality of lighting units face to one electron emitter structure 106 in the electron emission device 10.

Figure 4:
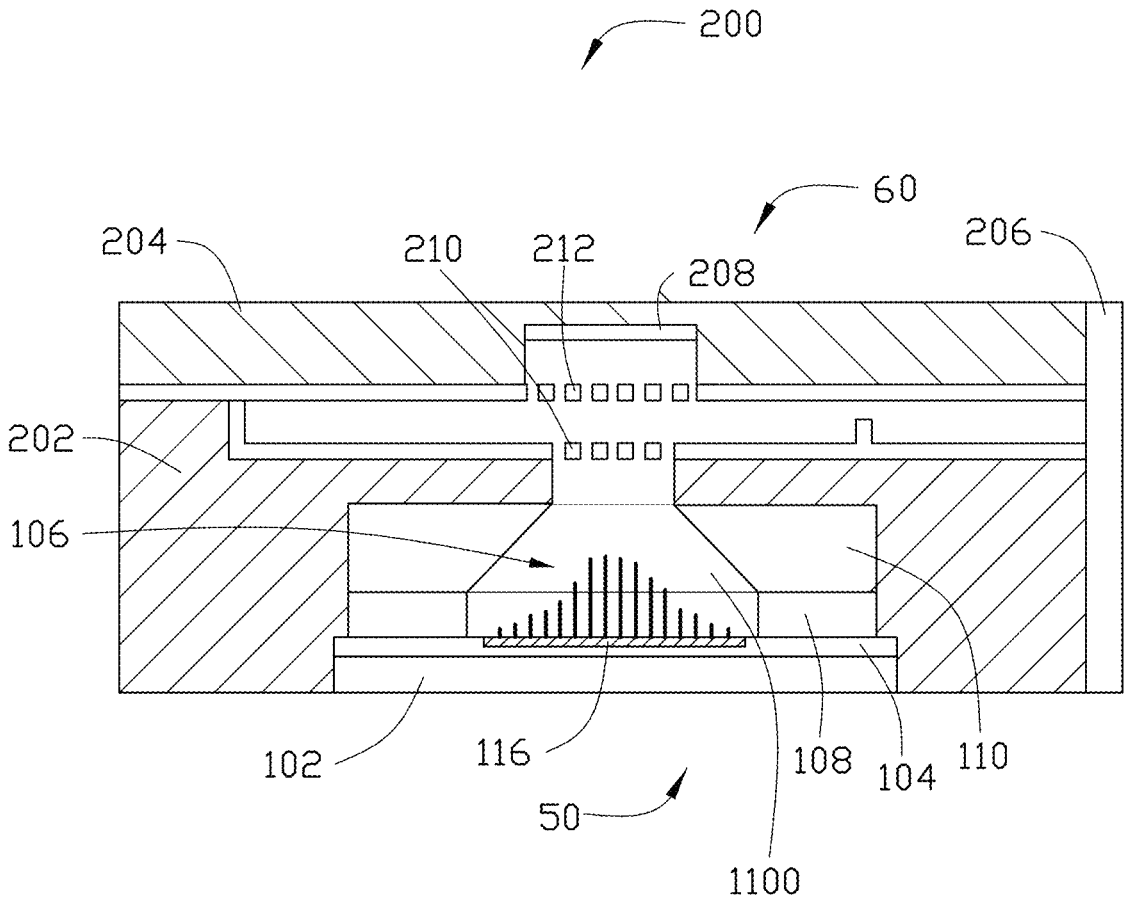
FIG. 4 shows a schematic view of one embodiment of a reflex klystron.

Referring to FIG. 4, a reflex klystron 200 comprises an electron emission structure 50 and an electron reflector structure 60. The electron emission structure 50 comprises a cathode 104, an electron extraction electrode 110, and an electron emitter structure 106 received in a first substrate 202. The electron reflector structure 60 comprises a reflective electrode 208 and a second grid 212 located on a second substrate 204. The pressure in the reflex klystron 200 is smaller than 100 Pascal. The first substrate 202 and the second substrate 204 are spaced from each other and coupled with each other to form a resonant cavity. A lens 206 is located at one side of the resonant cavity. The lens 206 is configured as an output portion to output waveguide.

The electron emission device is similar to the electron emission device 10, except that the electron emission device further comprises a first grid 210, and the anode 112 is omitted.

The first substrate 202 can defines a first cavity, and the electron emission structure 50 is received in the cavity. The first grid 210 is spaced from the electron extraction electrode 110 and cover the through hole 1100. While a voltage is applied on the first grid 210, the electrons can be extracted from the electron emitter structure 106.

The reflective electrode 208 is located on the second substrate 202, and the second grid 212 is spaced from the reflective electrode 208. The second grid 212 is spaced from the first grid 210. Furthermore, the second substrate 204 defines a second cavity with a bottom surface and a side surface. The reflective electrode 208 can be located at the bottom of the second cavity, and the second grid 212 can suspend on the cavity and face to the reflective electrode 208. The reflective electrode 208 is configured to reflect the electrons. While a voltage is applied between the reflective electrode 208 and the cathode 204, a retarding field can be formed between the second grid 212 and the reflective electrode 208 to decelerate the electrons. The second grid 212 is spaced from the first grid 210 and face to the first grid 210.

The electrons can be emitted from the electron emitter structure 106. The electrons can be accelerated by the first grid 210 and the second grid 212 to form an electron beam with enough current density. The electron beam can pass through the first grid 210, the resonance cavity, and the second grid 212. Thus the electron beam will be modulated by the microwave field in the resonance cavity. After the electron beam pass through the second grid 212, the electron beam will be reflected by the retarding field. All the electrons will be reflected by the retarding field. Thus the electron beam will be modulated on density in the retarding field. Therefore, the electrons will be oscillated in the resonance cavity. After the electron beam is modulated on density it will pass through the resonance cavity again and exchange energy with the microwave field. The kinetic energy of the electron beam will be transferred to microwave field. The microwave will be formed and output from the lens.

The material of the first substrate 202 and the second substrate 204 can be metal, polymer, or silicon. In one embodiment, the material of the first substrate 202 and the second substrate 204 is silicon.

Both the first grid 210 and the second grid 212 can comprise a carbon nanotube layer. The carbon nanotube layer defines a plurality of apertures to let the electrons pass through. A size of the aperture can range from about 1 nanometer to about 500 nanometers. Both the first grid 210 and the second grid 212 can have a thickness greater than or equal to 10 micrometers. Furthermore, the thickness can range from 30 nanometers to about 60 nanometers. Thus the first grid 210 and the second grid 212 can have enough mechanical strength to prolong the lifespan of the reflex klystron.

The carbon nanotube layer forms a pattern. The patterned carbon nanotube layer defines the plurality of apertures. The apertures can be dispersed uniformly. The apertures extend throughout the carbon nanotube layer along the thickness direction thereof. The aperture can be a hole defined by several adjacent carbon nanotubes, or a gap defined by two substantially parallel carbon nanotubes and extending along axial direction of the carbon nanotubes. The size of the aperture can be the diameter of the hole or width of the gap, and the average aperture size can be in a range from about 10 nm to about 500 μm, for example, about 50 nm, 100 nm, 500 nm, 1 μm, 10 μm, 80 μm or 120 μm. The hole-shaped apertures and the gap-shaped apertures can exist in the patterned carbon nanotube layer at the same time. The sizes of the apertures within the same carbon nanotube layer can be different. In one embodiment, the sizes of the apertures are in a range from about 10 nm to about 10 μm.

The carbon nanotubes of the carbon nanotube layer can be orderly arranged to form an ordered carbon nanotube structure or disorderly arranged to form a disordered carbon nanotube structure. The term 'disordered carbon nanotube structure' includes, but is not limited to, a structure where the carbon nanotubes are arranged along many different directions, and the aligning directions of the carbon nanotubes are random. The number of the carbon nanotubes arranged along each different direction can be substantially the same (e.g. uniformly disordered). The disordered carbon nanotube structure can be isotropic. The carbon nanotubes in the disordered carbon nanotube structure can be entangled with each other. The term 'ordered carbon nanotube structure' includes, but is not limited to, a structure where the carbon nanotubes are arranged in a consistently systematic manner, e.g., the carbon nanotubes are arranged approximately along a same direction and/or have two or more sections within each of which the carbon nanotubes are arranged approximately along a same direction (different sections can have different directions).

In one embodiment, all the carbon nanotubes in the carbon nanotube layer are arranged to extend along the same direction. In another embodiment, some of the carbon nanotubes in the carbon nanotube layer are arranged to extend along a first direction, and some of the carbon nanotubes in the carbon nanotube layer are arranged to extend along a second direction, perpendicular to the first direction.

In one embodiment, the carbon nanotube layer is a free-standing structure and can be drawn from a carbon nanotube array. The term "free-standing structure" means that the carbon nanotube layer can sustain the weight of itself when it is hoisted by a portion thereof without any significant damage to its structural integrity. Thus, the carbon nanotube layer can be suspended by two spaced supports.

The carbon nanotube layer can be a substantially pure structure of the carbon nanotubes, with few impurities and chemical functional groups. The carbon nanotube layer can be a composite including a carbon nanotube matrix and non-carbon nanotube materials. The non-carbon nanotube materials can be graphite, graphene, silicon carbide, boron nitride, silicon nitride, silicon dioxide, diamond, amorphous carbon, metal carbides, metal oxides, or metal nitrides. The non-carbon nanotube materials can be coated on the carbon nanotubes of the carbon nanotube layer or filled in the apertures. In one embodiment, the non-carbon nanotube materials are coated on the carbon nanotubes of the carbon nanotube layer so the carbon nanotubes can have a greater diameter and the apertures can a have smaller size. The non-carbon nanotube materials can be deposited on the carbon nanotubes of the carbon nanotube layer by CVD or physical vapor deposition (PVD), such as sputtering.

The carbon nanotube layer can include at least one carbon nanotube film, at least one carbon nanotube wire, or a combination thereof. In one embodiment, the carbon nanotube layer can include a single carbon nanotube film or two or more stacked carbon nanotube films. Thus, the thickness of the carbon nanotube layer can be controlled by the number of the stacked carbon nanotube films. The number of the stacked carbon nanotube films can be in a range from about 2 to about 100, for example, about 10, 30, or 50. In one embodiment, the carbon nanotube layer can include a layer of parallel and spaced carbon nanotube wires. The carbon nanotube layer can also include a plurality of carbon nanotube wires crossed or weaved together to form a carbon nanotube net. The distance between two adjacent parallel and spaced carbon nanotube wires can be in a range from about 0.1 μm to about 200 μm. In one embodiment, the distance between two adjacent parallel and spaced carbon nanotube wires can be in a range from about 1 μm to about 100 μm. The size of the apertures can be controlled by controlling the distance between two adjacent parallel and spaced carbon nanotube wires. The length of the gap between two adjacent parallel carbon nanotube wires can be equal to the length of the carbon nanotube wire. It is understood that any carbon nanotube structure described can be used with all embodiments.

In one embodiment, the carbon nanotube layer includes at least one drawn carbon nanotube film. A drawn carbon nanotube film can be drawn from a carbon nanotube array that is able to have a film drawn therefrom. The drawn carbon nanotube film includes a plurality of successive and oriented carbon nanotubes joined end-to-end by van der Waals attractive force therebetween. The drawn carbon nanotube film is a free-standing film. Each drawn carbon nanotube film includes a plurality of successively oriented carbon nanotube segments joined end-to-end by van der Waals attractive force therebetween. Each carbon nanotube segment includes a plurality of carbon nanotubes parallel to each other, and combined by van der Waals attractive force therebetween. Some variations can occur in the drawn carbon nanotube film. The carbon nanotubes in the drawn carbon nanotube film are oriented along a preferred orientation. The drawn carbon nanotube film can be treated with an organic solvent to increase the mechanical strength and toughness, and reduce the coefficient of friction of the drawn carbon nanotube film. A thickness of the drawn carbon nanotube film can range from about 0.5 nm to about 100 μm.

The carbon nanotube layer can include at least two stacked drawn carbon nanotube films. In other embodiments, the carbon nanotube layer can include two or more coplanar carbon nanotube films, and each coplanar carbon nanotube film can include multiple layers. Additionally, if the carbon nanotubes in the carbon nanotube film are aligned along one preferred orientation (e.g., the drawn carbon nanotube film), an angle can exist between the orientation of carbon nanotubes in adjacent films, whether stacked or adjacent. Adjacent carbon nanotube films are combined by the van der Waals attractive force therebetween. An angle between the aligned directions of the carbon nanotubes in two adjacent carbon nanotube films can range from about 0 degrees to about 90 degrees. If the angle between the aligned directions of the carbon nanotubes in adjacent stacked drawn carbon nanotube films is larger than 0 degrees, a plurality of micropores is defined by the carbon nanotube layer. In one embodiment, the carbon nanotube layer shown with the angle between the aligned directions of the carbon nanotubes in adjacent stacked drawn carbon nanotube films is 90 degrees. Stacking the carbon nanotube films will also add to the structural integrity of the carbon nanotube layer.

In one embodiment, the size of the aperture ranges from about 10 micrometers to about 100 micrometers. Thus the electrons absorbed by the first grid 210 and the second grid 212 can be reduced. Furthermore, the first grid 210 and the second grid 212 have great mechanical strength.

Figure 5:
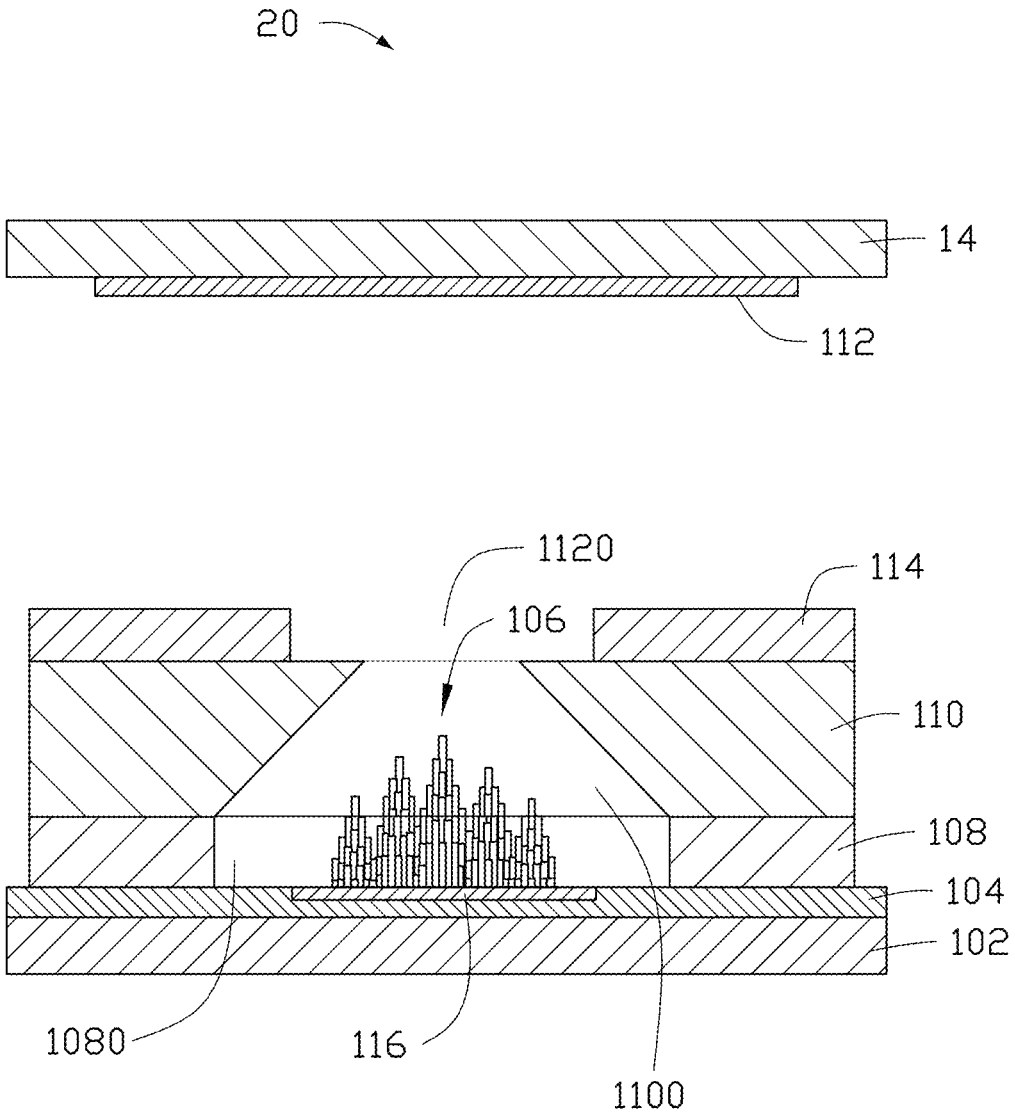
FIG. 5 shows a schematic view of another embodiment of an electron emission device.

Referring to FIG. 5, an electron emission device 20 of one embodiment comprises an insulating substrate 102, a cathode 104, an electron emitter structure 106, an insulating layer 108, an electron extraction electrode 110, and an anode 112.

The structure of the electron emission device 20 is similar to the electron emission device 10, except that the electron emitter structure 106 comprise a carbon nanotube wire, and the carbon nanotube wire comprises a plurality of carbon nanotubes.

The carbon nanotube wire can be untwisted or twisted. Treating the drawn carbon nanotube film with a volatile organic solvent can form the untwisted carbon nanotube wire. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes. Thus, the drawn carbon nanotube film will be shrunk into untwisted carbon nanotube wire. The untwisted carbon nanotube wire includes a plurality of carbon nanotubes substantially oriented along a same direction (i.e., a direction along the length of the untwisted carbon nanotube wire). The carbon nanotubes are parallel to the axis of the untwisted carbon nanotube wire. Specifically, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The carbon nanotube segments can vary in width, thickness, uniformity, and shape. Length of the untwisted carbon nanotube wire can be arbitrarily set as desired. A diameter of the untwisted carbon nanotube wire ranges from about 0.5 nm to about 100 μm.

The twisted carbon nanotube wire can be formed by twisting a drawn carbon nanotube film using a mechanical force to turn the two ends of the drawn carbon nanotube film in opposite directions. The twisted carbon nanotube wire includes a plurality of carbon nanotubes helically oriented around an axial direction of the twisted carbon nanotube wire. Specifically, the twisted carbon nanotube wire includes a plurality of successive carbon nanotube segments joined end to end by van der Waals attractive force therebetween. Each carbon nanotube segment includes a plurality of carbon nanotubes parallel to each other, and combined by van der Waals attractive force therebetween. Length of the carbon nanotube wire can be set as desired. A diameter of the twisted carbon nanotube wire can be from about 0.5 nm to about 100 μm. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent when the organic solvent volatilizes. The specific surface area of the twisted carbon nanotube wire will decrease, while the density and strength of the twisted carbon nanotube wire will be increased.

Figure 6:
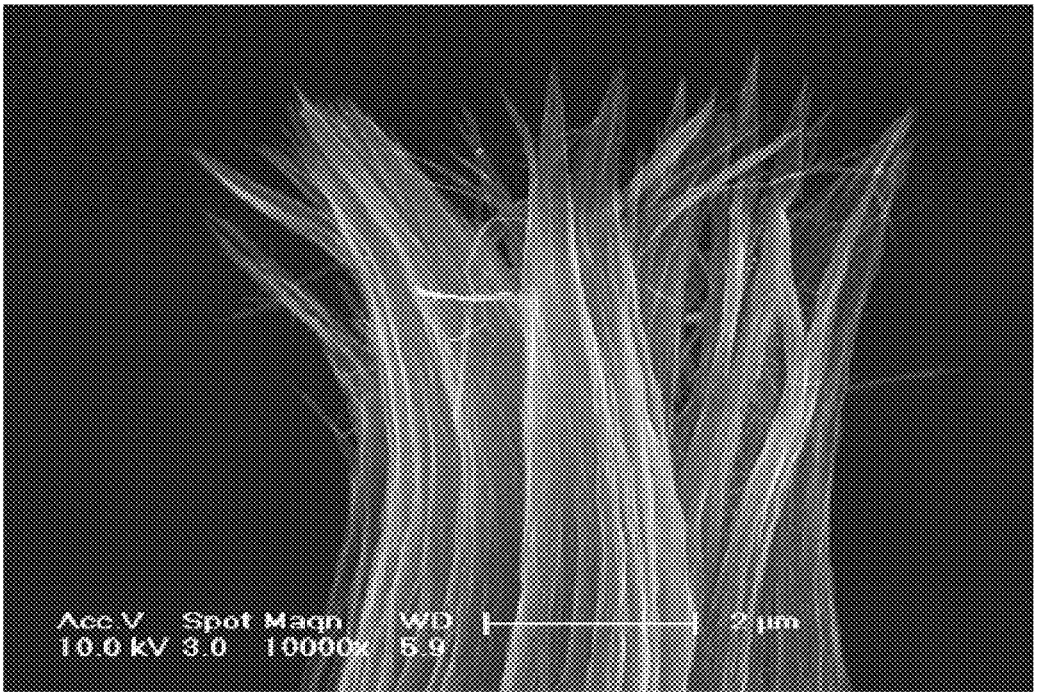
FIG. 6 shows a SEM image of carbon nanotube wire structure in the electron emission device.
Figure 7:
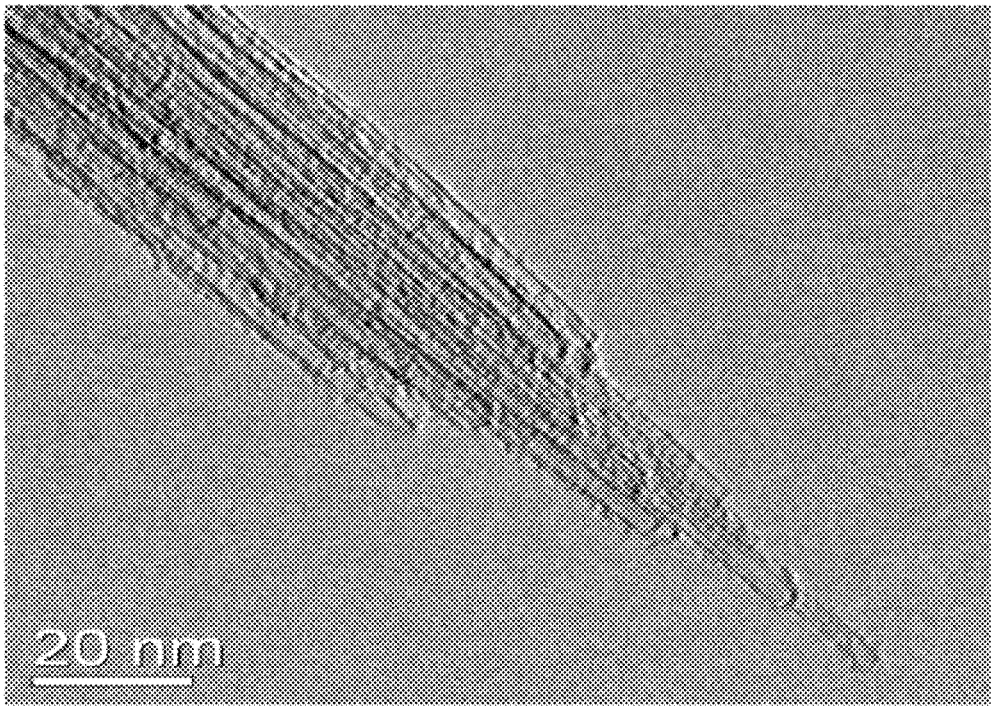
FIG. 7 shows a transmission electron microscope (TEM) image of a tip in the carbon nanotube wire structure.

Referring to FIGS. 6-7, the carbon nanotube wire comprises a first end and a second end. The first end is electrically connected to the cathode 104. The carbon nanotube wire is composed of a number of closely packed CNT bundles, and each of the CNT bundles includes a number of CNTs, which are substantially parallel to each other and are joined by van der Waals attractive force. A diameter of the carbon nanotube wire is in an approximate range from 1 to 100 microns. Each CNT bundle comprises one carbon nanotubes extending out of the CNT bundle and configured as the electron emission terminal.

The CNTs at the second end form a tooth-shaped structure, i.e., some of CNT bundles being taller than and projecting above the adjacent CNT bundles. Therefore, the shielding effect caused by the adjacent CNTs can be reduced. The voltage applied to the carbon nanotube wire for emitting electrons is reduced. The CNTs at the second end have smaller diameter. Furthermore, the tooth-shaped structure is similar to the sidewall of the through hole 1100. Thus a distance between the electron emission terminals in the electron emitter structure 160 and the sidewall is substantially the same. The distance can range from about 3 micrometers to about 300 micrometers. A difference between the distances can smaller than 100 micrometers.

Figure 8:
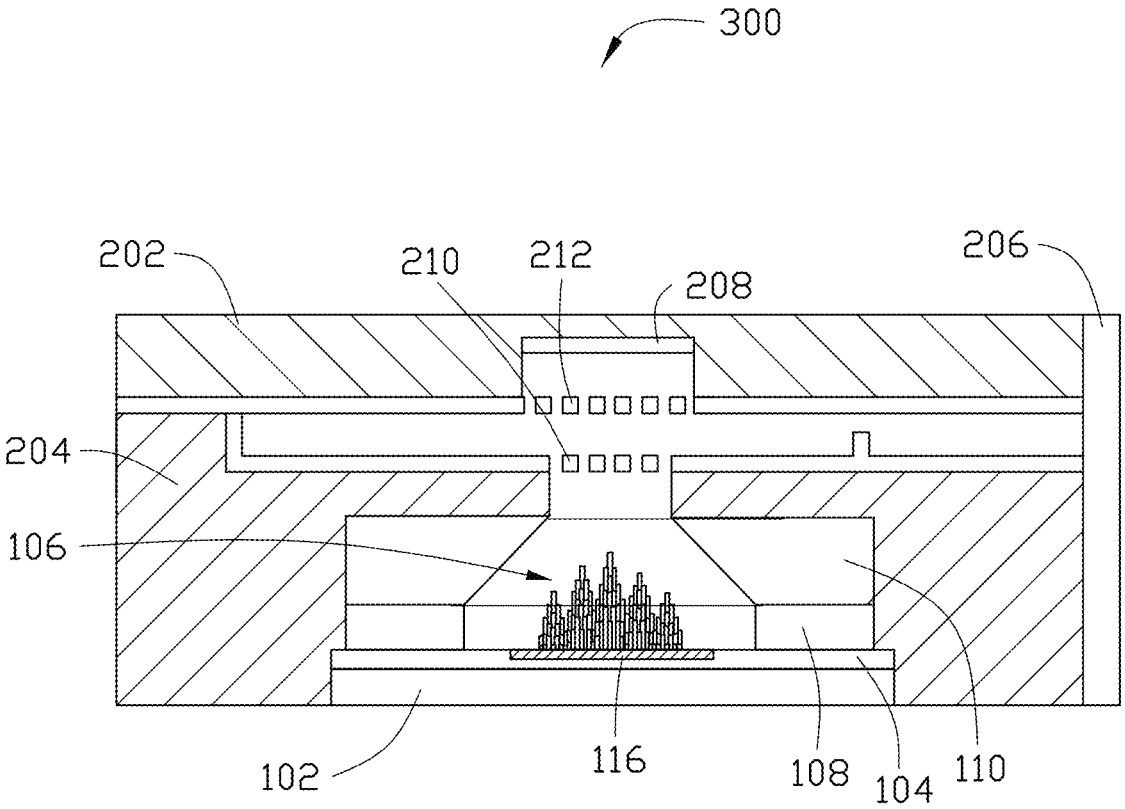
FIG. 8 shows a schematic view of another embodiment of a reflex klystron.

Referring to FIG. 8, a reflex klystron 300 with the electron emission device 20 of one embodiment comprises a first substrate 202, a second substrate 204, a lens 206, a first grid 210, a second grid 212, a reflective electrode 208, and an electron emission device 20.

The structure of the reflex klystron 300 is similar to the reflex klystron 200, except that the electron emitter structure 106 is a carbon nanotube wire comprising a plurality of CNT bundles.

Figure 9:
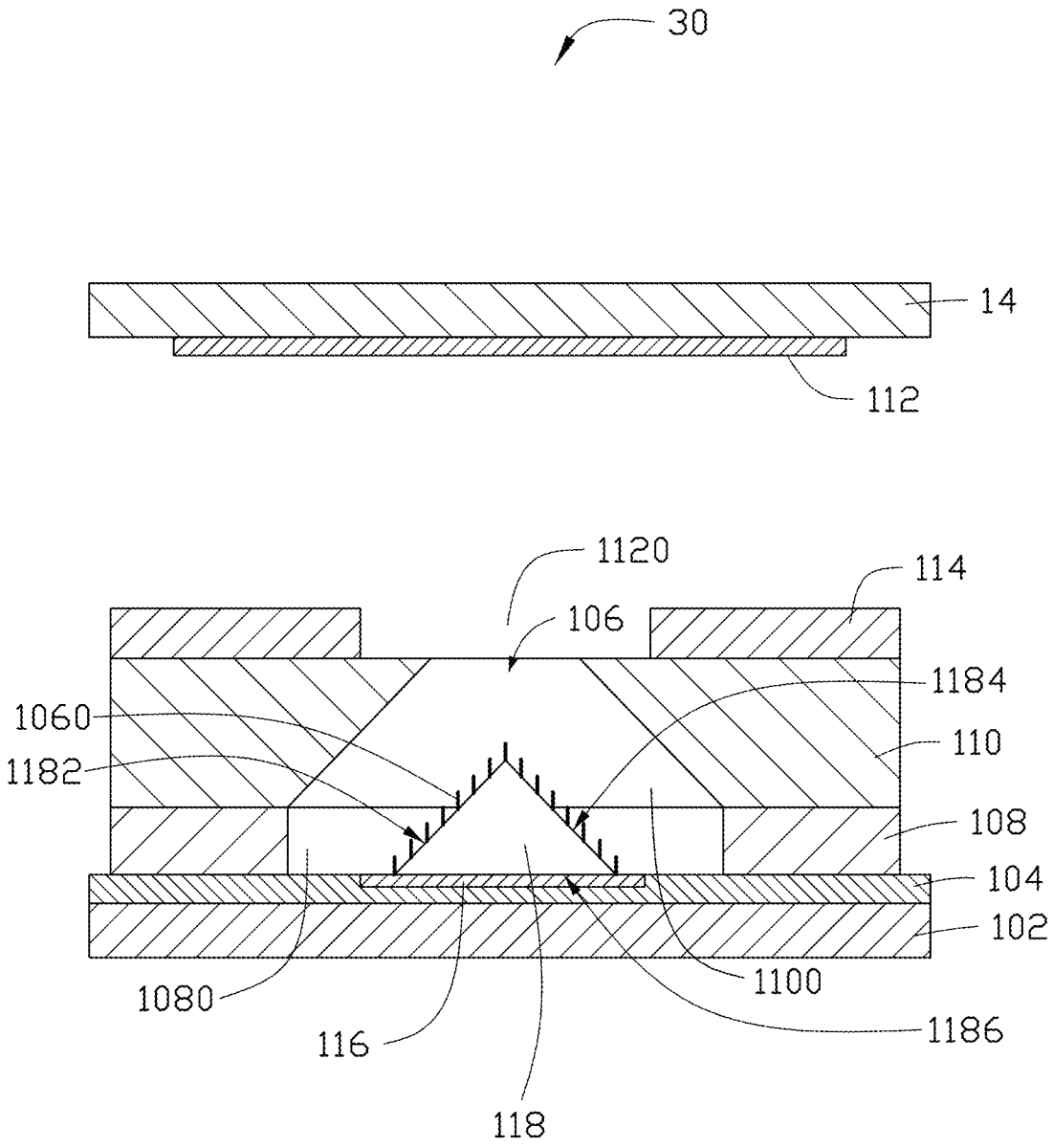
FIG. 9 shows a schematic view of another embodiment of an electron emission device.

Referring to FIG. 9, an electron emission device 30 of one embodiment comprises an insulating substrate 102, a cathode 104, an electron emitter structure 106, an insulating layer 108, an electron extraction electrode 110, and an anode 112.

The electron emission device 30 is similar to the electron emission device 10, except that the electron emitter structure 106 in the electron emission device 30 comprises a conductor 118 and a plurality of electron emitters 1060.

A cross-section of the conductor 118 is in a shape of triangle. The conductor 118 can be in a shape of pyramid or circular cone. In one embodiment, the conductor 118 can comprises a first surface 1182, a second surface 1184, and a third surface 1186. The third surface 1186 is electrically connected to the cathode 104. The first surface 1182 and the second surface 1184 are parallel with the sidewall of the through hole 1100. The first surface 1182 and the second surface 1184 are intersected with each other. The plurality of electron emitters 1060 are located on and electrically connected to the first surface 1182 and the second surface 1184.

Figure 10:
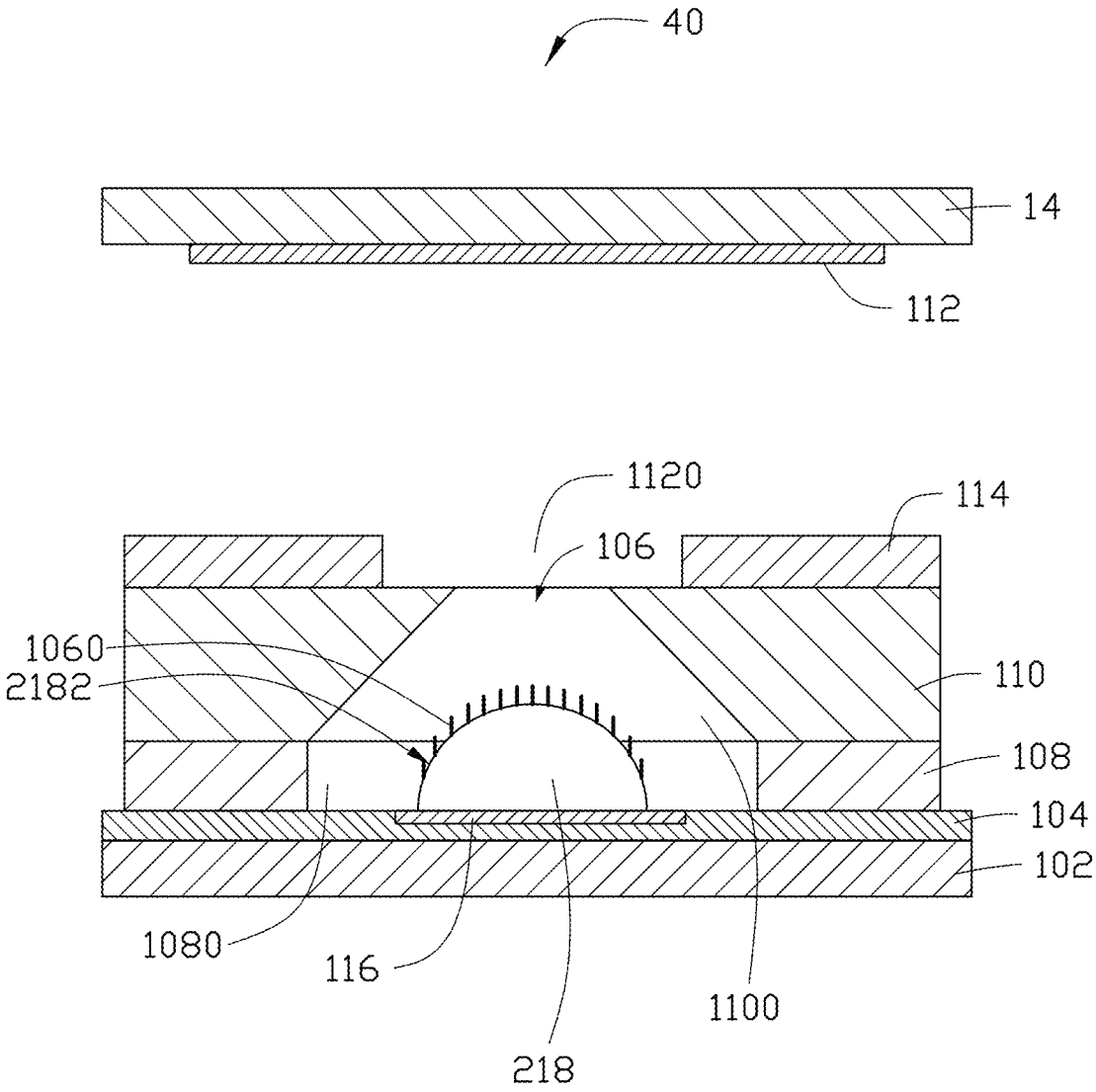
FIG. 10 shows a schematic view of another embodiment of an electron emission device.

Referring to FIG. 10, an electron emission device 40 of one embodiment comprises an insulating substrate 102, a cathode 104, an electron emitter structure 106, an insulating layer 108, an electron extraction electrode 110, and an anode 112.

The electron emission device 40 is similar to the electron emission device 30, except that the electron emitter structure 106 in the electron emission device 40 comprises a conductor 218 and a plurality of electron emitters 1060, and a shape of the conductor 218 is hemisphere.

The conductor 218 has a curved surface 2182. The curved surface 2182 faces to the sidewall of the through hole 1100. The plurality of electron emitters 1060 are distributed on the curved surface 2182.

The electron emission device and the reflex klystron have following advantages. The pressure in the electron emission device can smaller than 100 Pascal, the distance between the electron emitters and the anode is greater than 10 micrometers and smaller than 200 micrometers, the electron emission terminals of the electron emitters have the same distance to the sidewall of the through hole, thus the electric field around the plurality of electron emitters is substantially the same. Then the current emission density of the electron emitter structure can be improved, and THz wave can be conducted out by the reflex klystron. Furthermore, the atmosphere in the electron emission device can be air or inert gas, thus the difficulty of maintaining vacuum can be avoided. In addition, because the electron emitter structure has a shape of cone, and the electron emitter in the central portion is highest, thus the shielding effect can be reduced. Furthermore, the through hole of the electron extraction electrode is in the shape of inversed funnel, thus the electrons can be focused by the through hole, and the current emission density can be improved.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A reflex klystron, comprising:

a first substrate and a second substrate spaced from each other, wherein the first substrate and the second substrate are coupled together to form a resonant cavity;

a lens, wherein the lens is located on an end of the resonant cavity and configured as an output portion;

an electron emission device, wherein the electron emission device is configured to emit a plurality of electrons into the resonant cavity, the plurality of electrons are oscillated in the resonance cavity, and the electron emission device comprises:

an electron reflective structure on the second substrate, wherein the electron reflective structure comprises a reflective electrode and a second grid spaced from each other;

an electron emission structure on the first substrate, wherein the electron emission structure comprises a cathode, an electron extraction electrode, an electron emitter structure, and a first grid, the electron extraction electrode defines a through hole surrounded by a sidewall, the electron emitter structure comprises a plurality of electron emitters extending into the through hole, each of the plurality of electron emitters comprises an electron emission terminal, so that the electron emission structure has a plurality of electron emission terminals, first distances between the plurality of electron emission terminals and the sidewall are substantially the same, a second distance between each of the plurality of electron emission terminals and the reflective electrode is greater than or equal to 10 micrometers and smaller than or equal to 200 micrometers, and a pressure in the electron emission device is smaller than or equal to 100 Pascal.

2. The reflex klystron of claim 1, wherein a difference between each two first distances is smaller than or equal to 50 micrometers.

3. The reflex klystron of claim 1, wherein the through hole is in a shape of inversed funnel, the plurality of electron emitters are received into the through hole and space from the sidewall.

4. The reflex klystron of claim 3, wherein the through hole defines a second opening and a fourth opening opposite to the second opening, the fourth opening is adjacent to the cathode, and the second opening is smaller than the fourth opening.

5. The reflex klystron of claim 4, wherein the electron emission terminal extends into the fourth opening, and the first distance between the electron emission terminal and the sidewall is constant.

6. The reflex klystron of claim 1, wherein the electron emitter structure is in a shape of peak, one of the plurality of electron emitters in a center of the electron emitter structure is the highest.

7. The reflex klystron of claim 6, wherein a height of each of the plurality of electron emitters is gradually decreased along a direction away from the center.

8. The reflex klystron of claim 1, wherein the electron emitter structure is a carbon nanotube array comprising a plurality of carbon nanotubes, a height of each of the plurality of carbon nanotubes is gradually decreased from a center of the carbon nanotube array.

9. The reflex klystron of claim 1, wherein the first distance ranges from about 5 micrometers to about 100 micrometers.

10. The reflex klystron of claim 1, further comprising an ion bombardment resistance material on each of the plurality of electron emitters.

11. The reflex klystron of claim 10, wherein a material of the ion bombardment resistance material is selected from the group consisting of zirconium carbide, hafnium carbide, and lanthanum hexaboride.

12. The reflex klystron of claim 1, wherein the electron emitter structure comprises a carbon nanotube wire comprising a plurality of carbon nanotube bundles, and each of the plurality of carbon nanotube bundle comprises a plurality of carbon nanotubes parallel with each other and extending toward the sidewall.

13. The reflex klystron of claim 12, wherein one of the plurality of carbon nanotubes extends out of other of the plurality of carbon nanotubes.

14. The reflex klystron of claim 12, wherein a maximum height of each of the plurality of carbon nanotube bundles is gradually decreased from a center of the electron emitter structure.

15. The reflex klystron of claim 1, wherein the second grid is located between the first grid and the reflective electrode, and a third distance between the first grid and the second grid ranges from about 3 micrometers to about 25 micrometers.

16. The reflex klystron of claim 1, further comprising a resistor layer sandwiched between the cathode and the electron emitter structure, and a resistance of the resistor layer is greater than 10 GΩ.

17. A reflex klystron, comprising:

a first substrate and a second substrate spaced from each other, wherein the first substrate and the second substrate are coupled together to form a resonant cavity;

a lens, wherein the lens is located on an end of the resonant cavity and configured as an output portion;

an electron emission device, wherein the electron emission device is configured to emit a plurality of electrons into the resonant cavity, the plurality of electrons are oscillated in the resonance cavity, and the electron emission device comprises:

an electron reflective structure on the second substrate, wherein the electron reflective structure comprises a reflective electrode and a second grid spaced from each other;

an electron emission structure on the first substrate, wherein the electron emission structure comprises a cathode, an electron extraction electrode, an electron emitter structure, and a first grid, the electron extraction electrode defines a through hole surrounded by a sidewall, the electron emitter structure comprises a conductor and a plurality of electron emitters on the conductor and extending toward the through hole, each of the plurality of electron emitters comprises an electron emission terminal, a distance between the electron emission terminal and the sidewall is constant, and a pressure in the electron emission device is smaller than or equal to 100 Pascal.

18. The reflex klystron of claim 17, wherein a cross-section of the conductor is in a shape of triangle, the conductor comprises a first surface and a second surface facing to the sidewall, and the plurality of electron emitters are distributed on the first surface and the second surface.

19. The reflex klystron of claim 17, wherein the conductor is in a shape of hemisphere, the conductor comprises a curved surface, and the plurality of electron emitters are distributed on the curved surface.

20. An electron emission device, comprising:

an anode;

a cathode spaced from the anode;

an electron emitter structure electrically connected to the cathode;

an electron extraction electrode insulated from the cathode via an insulating layer, wherein the electron extraction electrode defines a through hole surrounded by a sidewall, and the electron emitter structure faces to the sidewall;

wherein the electron emitter structure comprises a plurality of electron emitters extending toward the sidewall, each of the plurality of electron emitters comprises an electron emission terminal, a first distance between the electron emission terminal of each of the plurality of electron emitters and the sidewall is constant, a second distance between the electron emission terminal and the anode is greater than or equal to 10 micrometers and smaller than or equal to 200 micrometers, and a pressure in the electron emission device is smaller than or equal to 100 Pascal.

* * * * *